US010632527B2

(12) United States Patent
Brummayer et al.

(10) Patent No.: US 10,632,527 B2
(45) Date of Patent: Apr. 28, 2020

(54) TUNDISH FOR A CONTINUOUS CASTING PLANT

(71) Applicant: voestalpine Stahl GmbH, Linz (AT)

(72) Inventors: Markus Brummayer, Aschach (AT); Viorel-Sergiu Ilie, Leonding (AT); Jakob Six, Randegg (AT); Raimund Wincor, Vöcklabruck (AT); Josef Stallberger, Linz (AT); Rainer Fuchs, St. Florian (AT); Thomas Wittner, Puchenau (AT)

(73) Assignee: voestalpine Stalh GmbH, Linz (AT)

( * ) Notice: Subject to any disclaimer, the term of this patent is extended or adjusted under 35 U.S.C. 154(b) by 58 days.

(21) Appl. No.: 15/537,514

(22) PCT Filed: Dec. 10, 2015

(86) PCT No.: PCT/EP2015/079238
§ 371 (c)(1),
(2) Date: Jun. 19, 2017

(87) PCT Pub. No.: WO2016/096596
PCT Pub. Date: Jun. 23, 2016

(65) Prior Publication Data
US 2018/0001376 A1 Jan. 4, 2018

(30) Foreign Application Priority Data
Dec. 18, 2014 (DE) ..... 10 2014 119 109

(51) Int. Cl.
*B22D 11/118* (2006.01)
*B22D 41/08* (2006.01)
(Continued)

(52) U.S. Cl.
CPC ..... *B22D 11/118* (2013.01); *B22D 11/103* (2013.01); *B22D 41/00* (2013.01); *B22D 41/08* (2013.01)

(58) Field of Classification Search
CPC ..... B22D 11/103; B22D 11/118; B22D 41/00; B22D 41/08
(Continued)

(56) References Cited

U.S. PATENT DOCUMENTS 4,770,395 A * 9/1988 Vo Thanh ..... B22D 11/10 164/335
4,776,570 A * 10/1988 Vo Thanh ..... B22D 11/118 266/229
(Continued)

FOREIGN PATENT DOCUMENTS

AT 405914 B 12/1999
DE 2216797 A1 3/1973
(Continued)

OTHER PUBLICATIONS

G. Hackl, et al., "Product Development and Flow Optimization in the Tundish by Modelling and Simulation," AISTech 2014 Proceedings, May 8, 2014, AIST Association for Iron & Steel Technology, XP002753902, ISBN: 978-1-935117-41-4.

*Primary Examiner* — Jessee R Roe
*Assistant Examiner* — Michael Aboagye

(57) ABSTRACT

A tundish, in particular a tundish for continuous steel casting for placement between a steel casting ladle and a continuous casting mold, with an inlet region and an outlet region, wherein in the inlet region, molten steel can be supplied in particular through a ladle shroud and in the outlet region, the molten steel can be drained from the tundish in particular by means of a plug and an outlet opening; in the vicinity of the inlet region in the tundish, a threshold or ramp is provided, which forms a region of the tundish bottom into a cup or
(Continued)

tundish; the threshold or ramp has at least one channel at the side, which locally reduces the height of the threshold or ramp or breaks through the threshold.

10 Claims, 5 Drawing Sheets

(51) Int. Cl.
*B22D 41/00* (2006.01)
*B22D 11/103* (2006.01)

(58) Field of Classification Search
USPC ..... 222/591, 594, 597, 607; 164/437, 335; 266/236, 226, 227, 229, 275, 78
See application file for complete search history.

(56) References Cited

U.S. PATENT DOCUMENTS

| | | | | |
|---|---|---|---|---|
| 6,074,600 | A | 6/2000 | Suer et al. | |
| 7,108,048 | B2 * | 9/2006 | Brummayer ..... | B22D 11/10 164/437 |

FOREIGN PATENT DOCUMENTS

| | | | | | |
|---|---|---|---|---|---|
| DE | 3337739 | A1 | | 5/1985 | |
| DE | 4006842 | A1 | | 9/1991 | |
| DE | 102009009740 | A1 | | 8/2010 | |
| EP | 0119853 | A2 | | 9/1984 | |
| EP | 0140217 | A1 | | 5/1985 | |
| EP | 0235340 | A1 | | 9/1987 | |
| EP | 0726115 | A1 | | 8/1996 | |
| EP | 0804306 | B1 | | 1/1999 | |
| GB | 2164281 | | * | 3/1986 | ..... B22D 11/118 |
| GB | 2164281 | A | | 3/1986 | |
| JP | H10216909 | A | | 8/1998 | |
| JP | 2000117401 | A | | 4/2000 | |

* cited by examiner prior art
1
2
3
4
5
6
7
8
9
10
11
12
13
14

1
3
8
11
6
15
15
17
17
4
5
16
16
7
2
9

3
11
10
6
10
16
17
13
2

TUNDISH FOR A CONTINUOUS CASTING PLANT

FIELD OF THE INVENTION

The invention relates to a distributor for continuous casting plants.

BACKGROUND OF THE INVENTION

Continuous steel casting is a known method for continuously casting steel girders.

For this purpose, steel is usually produced in a converter, transferred from the steel converter into a ladle, and is conveyed from the ladle through a tundish to the casting mold.

In this case, the purpose of the tundish is to ensure an uninterrupted flow of steel after one ladle has emptied and before the next ladle is supplied.

Basically, it is necessary to ensure that no inclusions are present in the molten steel, in particular no slag particles or pieces of the respective fireproof masonry or spray from the receptacles.

This is successfully achieved particularly through the arrangement of corresponding inserts in a tundish, which produces a certain upward flow after the steel is poured in such that the steel is stirred to the surface so that particles that are lighter than the steel travel into the slag or bind to the slag.

DE 33 37 739 A1 has disclosed a continuous casting plant. This continuous casting plant has a casting ladle holder and changer (ladle turret), casting ladles, and a tundish as well as a continuous casting mold and a continuous extraction device. The molten metal-filled casting ladle in the ready position for transport into the casting position is associated with a tundish for joint transport therewith. In this embodiment, the tundish is preferably inserted into the boom provided for receiving the casting ladle, on the ladle turret beneath the casting ladle. Tundish and/or casting ladles are provided with means for detachably fastening them to each other.

EP 0 119 853 A2 has disclosed a tundish for continuous casting; the tundish has a channeled induction heating device, which is positioned on the side wall of the tundish; and the device includes a channel that communicates with an opening in the side walls of the tundish.

EP 0 140 217 A1 has disclosed a method and device for changing casting ladles and intermediate receptacles in a continuous casting plant.

EP 0 726 115 A1 has disclosed a tundish for receiving and filtering molten ferrous metals, which has an outflow opening in its bottom region for dispensing the molten metal after it passes through a deflecting and/or filtering device; the tundish has a ceramic filter positioned in it that essentially covers the entire horizontal cross-section of the tundish, can be removed in a known way, extends essentially in the horizontal direction, and is provided with through openings, which are positioned in the through-flow direction of the molten metal through the tundish essentially in the vertical direction, which should make it possible, with a simple design, to clean and filter molten metals even for high casting speeds.

EP 0 804 306 B1 has disclosed a device for regulating the flow of molten metal in a tundish in order to improve the removal of inclusions from the molten metal bath. To this end, a flow-control dam is positioned downstream of an buffer and has an upper region that is embodied to receive a flow of molten steel exiting the buffer and deflect it into at least one sub-flow current, which flows to the slag cover in a downstream direction, and into at least one sub-flow current that flows to the slag cover in an upstream direction. In the final analysis, it is an installed dam that is intended to prevent a short-circuit flow.

U.S. Pat. No. 6,074,600 has disclosed a modification of a tundish dam for minimizing turbulence. In particular, it is intended to reduce the formation of gas bubbles and slag inclusions. This should in particular be achieved in the initial filling of the tundish. To this end, on the one hand, a kind of weir is positioned between the steel inlet of the tundish and the steel outlet of the tundish; the weir reaches from the surface of the bath to the bottom, but is spaced apart from the bottom. In addition, a ramp is provided between the weir and the steel outlet, while a second ramp is positioned in front of the weir.

DE 10 2009 009 740 A1 has disclosed positioning vortex elements in the region of the bottom outlets in order to avoid eddies in receptacles that contain molten steels, in fact by positioning them so that their cutting edges reach into the eddy. The vortex elements are composed of a circular segment-like flat fixing part and the braking part with the cutting edge; this one-piece component is placed practically on the bottom outlet or better still on a nozzle brick and can be attached to it because the inner diameter corresponds to that of the bottom outlet.

DE 22 16 797 has disclosed passages for casting that are embodied in a form in which molten metal is poured into a passage in such a way that the molten metal must flow around a wall before it reaches an outlet or this passage is embodied in the form of a cup, before the metal arrives in the actual casting mold.

JP 10 21 69 09 A has disclosed a tundish for continuous casting of steel in which barrier walls with openings at the bottom and subsequent walls at the bottom are provided in order to deoxidize the steel.

EP 02 35 34 0 has disclosed an anode system for a plasma heating that can be used in a tundish.

AT 405 914 B has disclosed a tundish for continuous casting of steel in which a recessed cup with a subsequent wall is provided in the bottom on the inlet side.

It is also known to provide a tundish with a bottom recess extending from the steel inlet to the steel outlet; onto this inclined bottom, which is partly also a stepped, inclined bottom, a wall or a raised area is placed in such a way that the steel outlet region forms a kind of cup from which, after the cup is filled, an overflow passes over the wall and then the entire tundish is filled. The purpose of this wall is likewise to ensure a turbulent flow and to lengthen the holding time of the steel in the tundish somewhat and in particular, to achieve a contact with the slag layer.

The object of the invention is to create a distributor geometry, which while retaining or improving the particle removal is more effective and economical.

SUMMARY OF THE INVENTION

Currently, the tundish geometry is embodied in such a way that in the inlet region of the tundish, i.e. in the region of the ladle shroud, in which the molten steel travels into the tundish, the geometry of the tundish bottom is embodied in the form of a cup that is closed at the sides (side walls, end walls) and at the bottom. In particular, this cup has dimensions of 1 m wide, 1 m long, and 20 cm high. This cup is open at the top and is also filled with molten steel from above by the ladle through the ladle shroud. Once this cup is filled, then the overflow passes over the wall, the insert, the ramp, and the wall that divides the cup from the rest of the tundish and fills the entire tundish.

The primary purpose of this cup- or basin-shaped bottom geometry in the vicinity of the inlet, which is also referred to below for short as the cup, is to deflect the molten steel flow induced by means of the ladle and ladle shroud in the tundish inlet region toward the bath surface of the tundish.

The advantages of the known geometry are that an increase in the holding time of particles and thus in the likelihood of particle removal in the molten steel flow in the tundish is achieved.

In addition, short-circuit flows in the direction toward the tundish outlet, i.e. through the casting tube into the mold, are prevented.

According to the invention, however, it has been discovered that when the tundish is emptied, a significant residual quantity of steel remains in this cup, which is declared scrap after the tundish cools. This is not economical. Consequently, the intent of the invention is to reduce the residual quantity of steel in the tundish, increase the output, and maintain at least the existing level of particle removal behavior of the tundish. In addition, short-circuit flows should be avoided in which the molten steel from the ladle flows through the ladle shroud directly, i.e. by the shortest path, into the vicinity of the bottom of the tundish in the direction toward the tundish outlet and travels through the casting tube into the mold. Particles in this short-circuit flow in the tundish cannot be removed at the bath surface of the tundish and in this way, travel along with the molten steel directly into the mold, a phenomenon that must absolutely be avoided.

According to the invention, it has been discovered that under certain circumstances, it is possible to selectively provide the cup geometry in the bottom region of the tundish inlet with openings in such a way that the dam, which divides the cup from the rest of the tundish cavity, is partially perforated.

These openings provided in the direction toward the tundish outlet and in particular, channels that are open toward the top are embodied starting from the two lateral long-side boundaries (longitudinal walls) of the tundish and oriented in the direction of the longitudinal axis of the tundish and in particular, reach to the bottom of the cup.

Preferably, these openings are embodied as symmetrical to the longitudinal axis of the tundish.

This forms lateral channels or at least one lateral channel. Relative to the overall cross-section of the tundish bottom in the region of the wall or of the insert, the lateral channels or lateral channel have/has a total flow cross-sectional area that is between 10% and 30%, preferably between 15% and 25%, of the cross-sectional area of the cup.

Relative to the entire area of the tundish bottom, the area of the wall or of the insert is preferably less than 50% of the total area, particularly preferably less than 40% of it.

The channel or channels can be spaced slightly apart from the respective side wall, i.e. from 0.01% to 25% of the width of the tundish interior.

The lateral arrangement of the channels avoids a short-circuit flow and the particle removal in the tundish is surprisingly retained at least at the same level as in the geometry without lateral channels. In tests, it was even discovered that the additional lateral channels for emptying the cup in the inlet region even tended to achieve an improvement with regard to the particle removal and short-circuit behavior.

In this case, it is particularly also advantageous that with a steel plant that is utilized to normal capacity, a significant residual quantity of steel, which would otherwise be scrapped, is made use of. This enables a significant increase in the number of utilizable casts.

Apart from this fact, this makes it significantly easier to break out the tundish and replace the fireproof inner lining.

BRIEF DESCRIPTION OF THE DRAWINGS

The invention is explained by way of example below based on the drawings. In the drawings.

DETAILED DESCRIPTION OF THE PREFERRED EMBODIMENTS

Figures 1, 2:
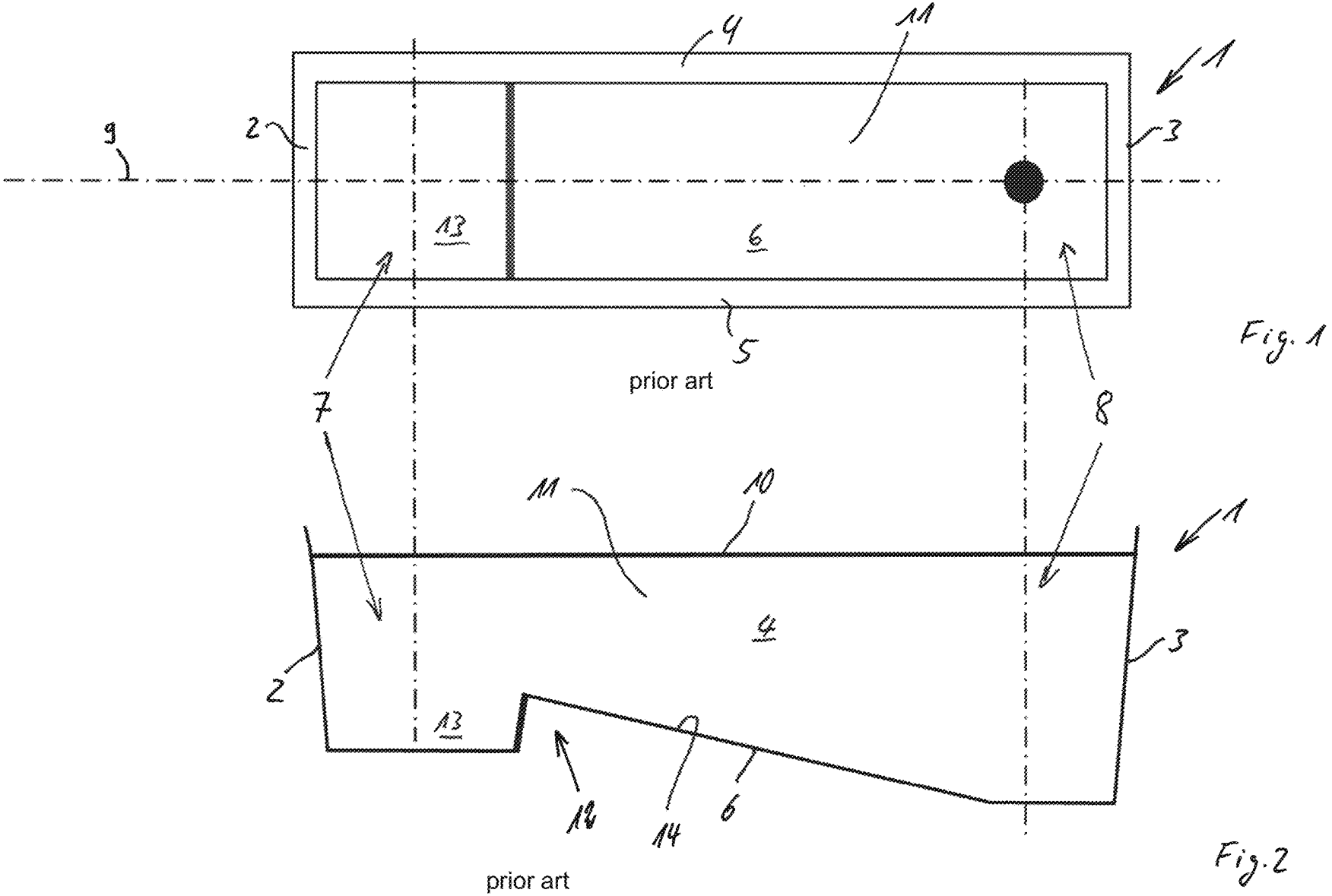
Fig. 2 prior art
FIG. 1: is a very schematic depiction of a tundish according to the prior art in a view from above.
FIG. 2: shows a cross-sectional view of the tundish according to FIG. 1.

A tundish 1 according to the invention is an elongated trough-like receptacle with two opposing end walls 2, 3 and two side walls 4, 5 connecting the end walls (FIG. 1 and FIG. 2).

The tundish 1 also has a bottom 6; an inlet region 7 and an outlet region 8 are provided along a longitudinal axis 9 of the tundish 1. In this case, the inlet region 7 is situated adjacent to an inlet-side end wall 2, while the outlet region 8 is embodied adjacent to an outlet-side end wall 3 so that basically, incoming steel flows through the receptacle along the longitudinal span of the tundish 1.

The bottom 6 of the tundish 1 can deepen extending in an inclined fashion from an inlet region 7 to an outlet region 8, where in this context, "extending in an inclined fashion" means that the depth relative to a bath level 10 increases.

At the bottom 6 of the tundish 1 toward the interior 11 of the tundish 1, a threshold 12 or ramp 12 is provided in such a way that it forms a recessed cup 13 in the inlet region 7 of the tundish 1. In particular, this cup 13 is embodied as recessed, rectangular, and trough-like. The threshold 12 or ramp 12 constitutes a closed boundary of the cup 13 oriented toward the interior 11 in the direction of the tundish outlet 8 and in particular, can have a slight inclination similar to a ski jump.

The tundish bottom 6 in this case can slope downward from an upper edge 12*a* of the threshold 12 with a sustained inclination 14 in the direction toward the tundish outlet 8. Preferably, the bottom 6 in the vicinity of the inlet region 7 and the outlet region 8 is flat relative to a bath surface 10. In this case, the "bath surface" 10 is intended to mean the maximum bath surface 10 during operation of the tundish 1. As the tundish 1 is being emptied, the bath surface drops from the maximum bath surface 10 during operation.

Figures 3, 4:
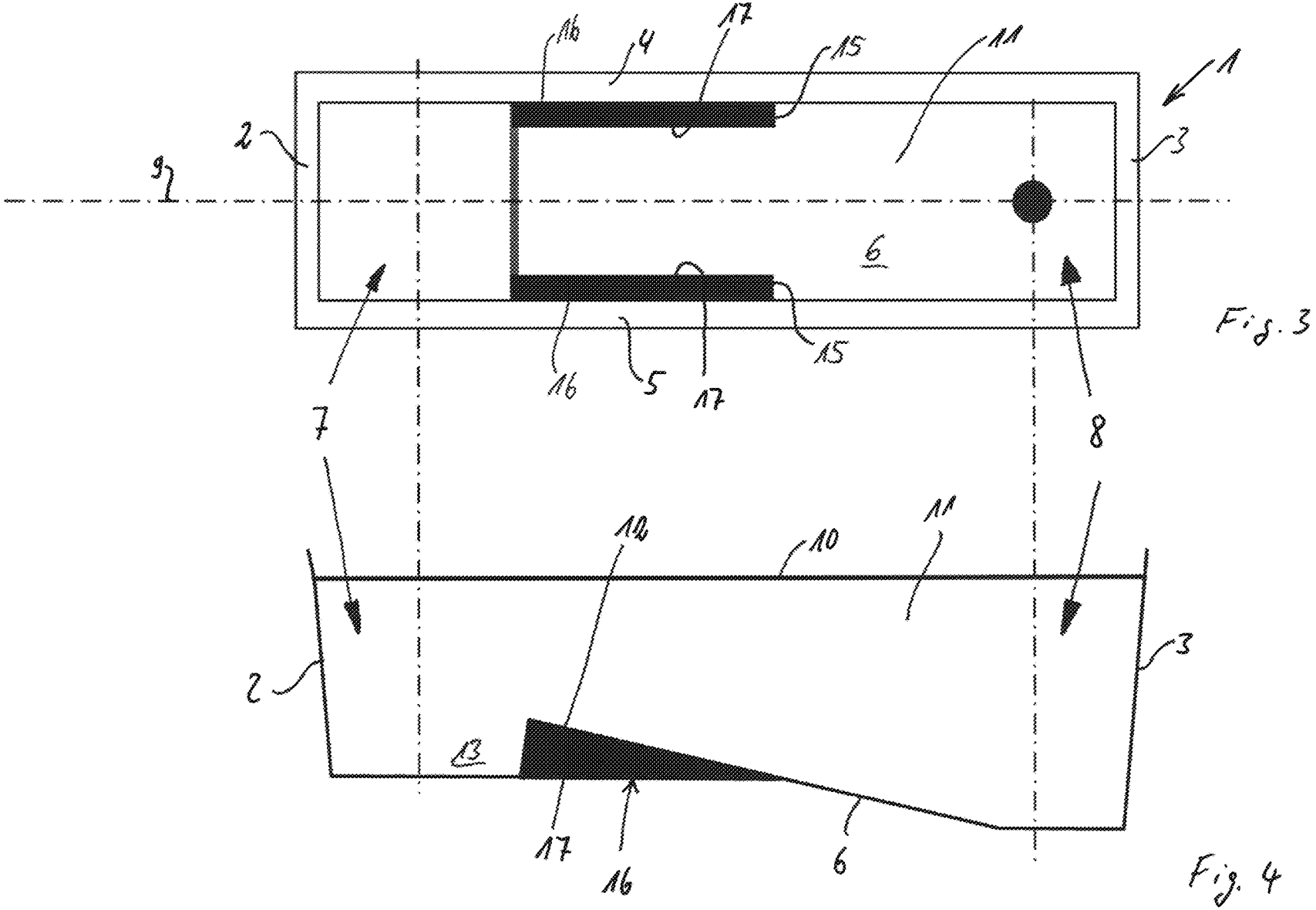
FIG. 3: is a very schematic top view of a tundish according to the invention.
FIG. 4: is a cut-away side view of the tundish according to FIG. 3.

According to the invention, (FIG. 3 and FIG. 4), at least along a side wall 4, 5, the boundary of the cup 13 or the threshold 12 or ramp 12—in the direction toward the tundish outlet 8—is embodied with a channel-like breach 15, which extends from the upper edge 12*a* of the threshold 12 or ramp 12, preferably down to a level of the bottom 6 in the vicinity of the inlet region 7.

This ensures that residual steel can flow out of the cup 13 and travel into the outlet region 8.

To this end, it is particularly possible for the channel bottom 16 of the channels 15 to have a slight inclination down to the tundish outlet region 8.

The channels 15 are thus delimited on the one hand by their channel bottom 16 and on the other by a side wall 4, 5 and a channel wall 17 of the threshold 12 or ramp 12.

In this case, the channels 15 can also be spaced somewhat apart from the side walls 4, 5 so that the threshold 12 is not perforated at the edges, but is instead the perforation is shifted a short distance toward the longitudinal axis 9.

Figure 7:
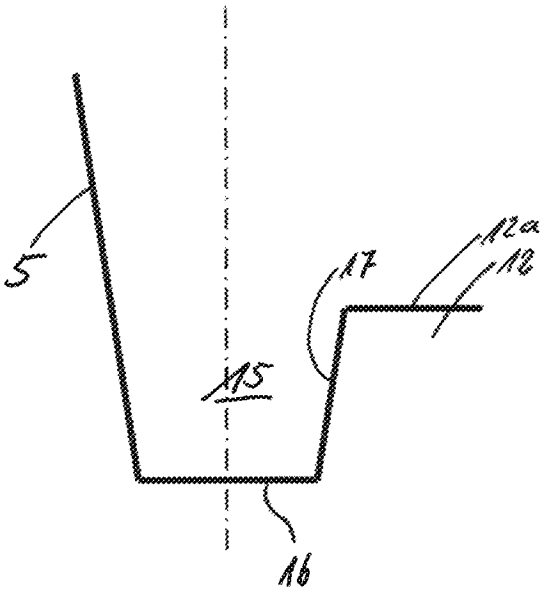
FIG. 7: shows a cross-section through a channel according to the invention at the bottom of the tundish.
Figure 6:
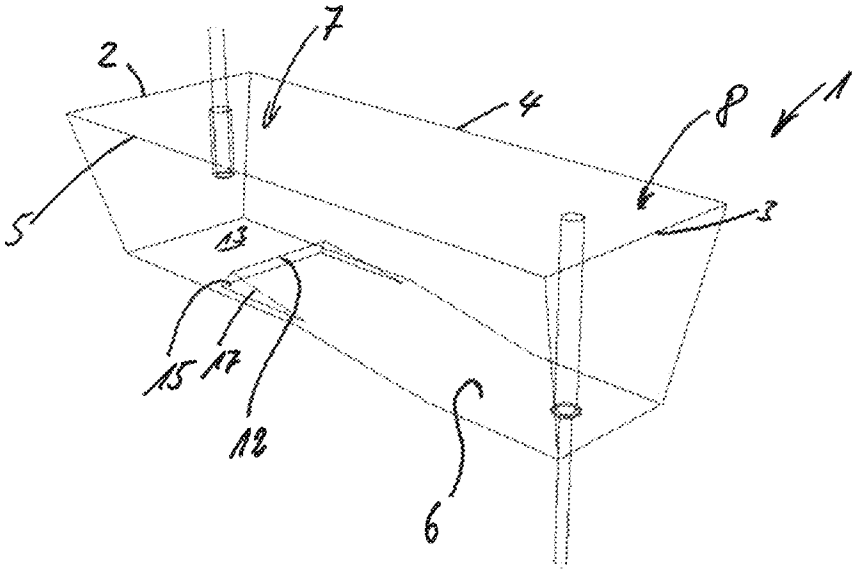
FIG. 6: shows a very schematic isometric, partially sectional view of the tundish according to the invention.

With a conventional tundish geometry, the channel 15 or channels 15 has/have a width, for example, of 70 mm to 80 mm and a height that corresponds to the height of the threshold 12; it turns out to be advantageous if the walls 4, 5, or 7 adjoining the channels 15 get wider as they extend away from the channel bottom 16, for example with an angle of 10° to 20° (FIG. 6 and FIG. 7).

Figure 9:
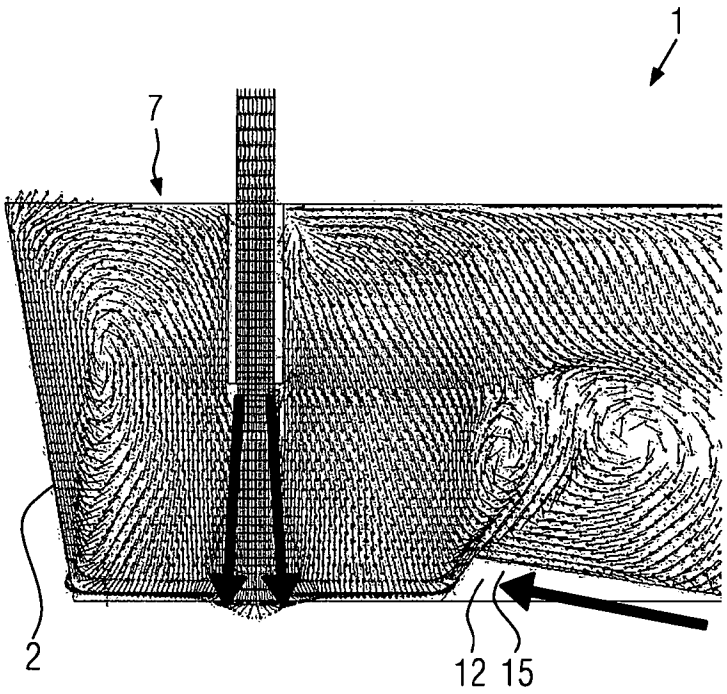
FIG. 9: shows the flow profile when steel is introduced into the tundish according to the invention.
Figure 8:
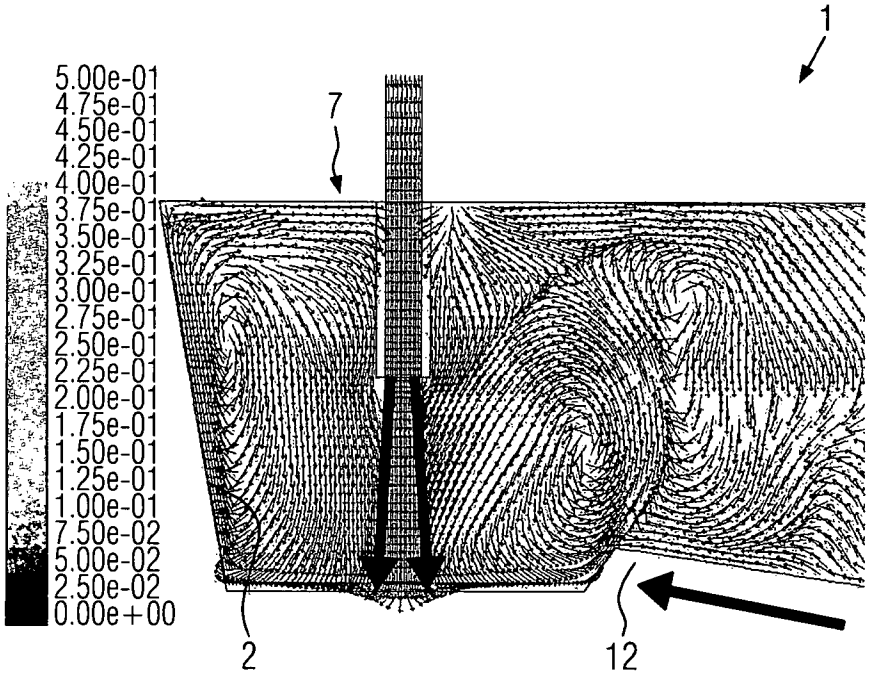
FIG. 8: shows the flow profile at the inlet of steel into the tundish according to the prior art.

In flow simulations (FIG. 8 and FIG. 9), it has turned out that in comparison to the prior art (FIG. 8), because of the lateral channels (FIG. 9), with the continuous filling of the tundish, in both cases, a distinct back flow is produced along the inclined bottom and along the threshold 12 or ramp 12 and the channel or channels 15 provided do not hinder this back flow and also do not negatively affect the holding time of the particles and the particle flow in the tundish.

Figure 5:
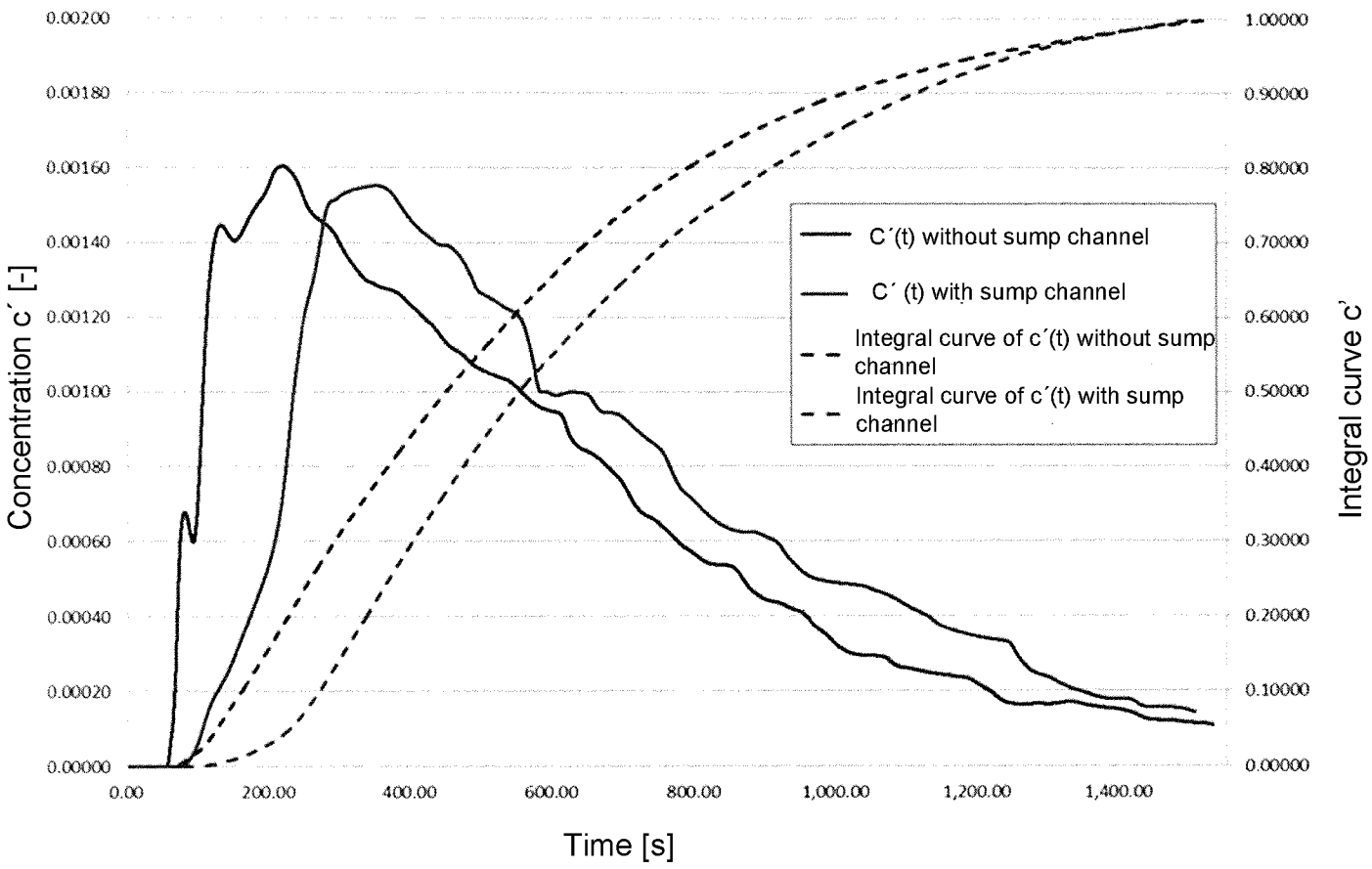
FIG. 5: shows the results of numerical CFD calculations (RTD curves)

Instead, it has been demonstrated that despite or because of the lateral channels, there is a surprising further improvement of the holding time (FIG. 5).

The threshold 12 or ramp 12 can be positioned perpendicular to the longitudinal axis 9 of the tundish 1; it can also extend in a rounded or curved fashion.

The threshold 12 has a height that is lower than the maximum bath surface 10 during operation of the tundish 1 in order not to negatively influence the particle flow.

Preferably, the threshold 12 has a height whose ratio relative to the bath surface 10 is less than 1:5, preferably less than 1:10.

The invention has the advantage that the channel or channels 15 provided surprisingly do(es) not negatively affect the particle removal behavior, but rather improve(s) it; in addition, a residual emptying of the cup is enabled, which makes it possible to work in a significantly more economical way.

The invention claimed is:

1. A tundish for continuous steel casting for placement between a steel casting ladle and a continuous casting mold, comprising:

a tundish bottom and side wall delimiting an inlet region in which molten steel is supplied and an outlet region from which the molten steel is drained from the tundish;

a threshold or ramp in the inlet region in the tundish extending along the tundish bottom down to the outlet region, wherein the threshold or ramp forms a region of the tundish bottom into a cup and the threshold or ramp is delimited by at least one channel wall spaced apart from at least one of the side walls of the tundish;

at least one channel connecting the inlet region and the outlet region along the tundish bottom, with the at least one channel delimited by a respective side wall of the tundish and a channel wall of the threshold or ramp, wherein a height of the threshold or ramp is reduced from the inlet region to the outlet region; and the threshold or ramp has a height that is less than a height from the tundish bottom to a top edge of the side walls of the tundish.

2. The tundish according to claim 1, wherein the height of the threshold or ramp is reduced from a maximum height in the inlet region to a lowest level of the tundish bottom as the at least one channel wall extends toward the outlet region.

3. The tundish according to claim 1, wherein the at least one channel has an inclination that corresponds to a shape of the bottom without the threshold or ramp.

4. The tundish according to claim 1, wherein the threshold or ramp has a height relative to the height from the tundish bottom to the top edge of the side walls of the tundish of less than 1:5.

5. The tundish according to claim 1, wherein a bottom of the at least one channel has an inclination of 2° to 6° from the inlet region to the outlet region.

6. The tundish according to claim 1, wherein in the inlet region of the tundish, molten steel is supplied through a ladle shroud and the molten steel is drained from the tundish by a plug and an outlet opening.

7. The tundish according to claim 1, wherein the at least one channel have a width that does not exceed 30% of a width of the tundish interior overall.

8. The tundish according to claim 1, wherein the at least one channel is or are spaced slightly apart from the respective side wall by 0.01% to 25% of a width of the tundish interior.

9. The tundish according to claim 1, wherein walls delimiting the at least one channel respectively widen the channel starting from its channel bottom, in particular with an angle of 2.5° to 25°.

10. The tundish according to claim 1, wherein an area of the threshold or ramp is less than 50% of a total area of the tundish bottom.

* * * * *